US009047819B2

(12) United States Patent
Kim et al.

(10) Patent No.: US 9,047,819 B2
(45) Date of Patent: Jun. 2, 2015

(54) ORGANIC LIGHT EMITTING DISPLAY HAVING UNIFORM BRIGHTNESS

(75) Inventors: Na-Young Kim, Yongin (KR); Ki-Nyeng Kang, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 348 days.

(21) Appl. No.: 13/118,124

(22) Filed: May 27, 2011

(65) Prior Publication Data

US 2012/0050344 A1 Mar. 1, 2012

(30) Foreign Application Priority Data

Aug. 24, 2010 (KR) ..... 10-2010-0082083

(51) Int. Cl.
*G09G 5/10* (2006.01)
*G09G 3/32* (2006.01)

(52) U.S. Cl.
CPC ..... *G09G 3/3233* (2013.01); *G09G 2300/0426* (2013.01); *G09G 2300/0861* (2013.01); *G09G 2310/0262* (2013.01); *G09G 2320/045* (2013.01)

(58) Field of Classification Search
CPC ..... H01L 27/3276; H01L 51/5203; G09G 2300/0866; G09G 2320/045; G09G 2300/0426; G02F 1/136286
USPC ..... 345/36, 39, 44–46, 76–86, 204–215; 257/E33.06, 99, 369, 370, 377
See application file for complete search history.

(56) References Cited

U.S. PATENT DOCUMENTS

| | | | | |
|---|---|---|---|---|
| 7,521,351 | B2 * | 4/2009 | Mikolajick et al. | 438/622 |
| 8,514,211 | B2 * | 8/2013 | Choi et al. | 345/211 |
| 2005/0116232 | A1 * | 6/2005 | Kim et al. | 257/72 |
| 2006/0007077 | A1 * | 1/2006 | Joo et al. | 345/77 |
| 2008/0042946 | A1 * | 2/2008 | Park et al. | 345/82 |
| 2008/0150844 | A1 * | 6/2008 | Choi | 345/76 |
| 2009/0102760 | A1 * | 4/2009 | Yamashita et al. | 345/76 |
| 2009/0135104 | A1 * | 5/2009 | Jeong | 345/76 |
| 2009/0284449 | A1 * | 11/2009 | Lee et al. | 345/76 |
| 2010/0171917 | A1 * | 7/2010 | Park et al. | 349/139 |
| 2012/0018764 | A1 * | 1/2012 | Choi et al. | 257/99 |

* cited by examiner

*Primary Examiner* — Kent Chang
*Assistant Examiner* — Gerald Oliver
(74) *Attorney, Agent, or Firm* — Robert E. Bushnell, Esq.

(57) ABSTRACT

An organic light emitting display is capable of preventing brightness from being non-uniform due to IR drop so as to improve reliability of the organic light emitting display. The organic light emitting display comprises: a display panel having a display region and a non-display region; a plurality of sub pixels defined by perpendicularly intersecting a plurality of gate lines and a plurality of data lines formed in the display region of the display panel; and a power source supply pad unit provided in the non-display region of the display panel for supplying a power source voltage to the plurality of sub pixels. A resistance value of sub pixels arranged in a first region adjacent to the power source supply pad unit is higher than a resistance value of sub pixels of a second region which is separated from the power source supply pad unit, with the first region interposed therebetween.

11 Claims, 6 Drawing Sheets

[A] [B]

ORGANIC LIGHT EMITTING DISPLAY HAVING UNIFORM BRIGHTNESS

CLAIM OF PRIORITY

This application makes reference to, incorporates the same herein, and claims all benefits accruing under 35 U.S.C. §119 from an application earlier filed in the Korean Intellectual Property Office on the 24 Aug. 2010 and there duly assigned Serial No. 10-2010-0082083.

BACKGROUND OF THE INVENTION

1. Field of the Invention

The present invention relates to an organic light emitting display and, more particularly, to an organic light emitting display which is capable of preventing non-uniform brightness due to IR drop so as to improve the reliability of the organic light emitting display.

2. Description of the Related Art

Recently, with the development of an information-oriented society, while various requests for organic light emitting displays have increased, research on displays such as liquid crystal displays (LCD), plasma display panels (PDP), field emission displays (FED), electrophoretic displays (EPD), and organic electroluminescence emitting displays (OLED) has been actively performed.

In the organic light emitting display, the generation of light by recombination of electrons supplied by a cathode and holes supplied by an anode takes place.

The organic light emitting display may realize low voltage driving, has a high response speed and high brightness, is made thin, and may realize all of the colors in a visible region to satisfy various requests of modern people.

The organic light emitting display includes power source wiring lines which are electrically coupled to a power source supply pad unit for supplying power to a plurality of sub pixels defined by gate wiring lines and data wiring lines which perpendicularly intersect each other. The power source wiring lines are arranged from the outline of one end of a display panel to the outline of the other end of the display panel. The sub pixel close to the power source supply pad unit emits light with high brightness, and the sub pixel remote from the power source supply pad unit emits light with low brightness.

As the organic light emitting display is enlarged, the length of the power source wiring lines increases and non-uniformity of brightness due to the IR drop of the power source wiring lines increases as the length of the power source wiring lines increases. Recently, in order to compensate for the IR drop of the power source wiring lines, a method of arranging the power source wiring lines in a row line rather than in a column line has been provided in order to compensate for the IR drop of the power source wiring lines.

However, the resistance of the power source wiring lines of sub pixels remote from sub pixels which are close to a first row line increases in proportion to the length of the power source wiring lines. In addition, the resistance of the power source wiring lines of sub pixels remote from sub pixels which are close to a first column line increases in proportion to the length of the power source wiring lines. The voltages supplied to sub pixels having different power source wiring lines are not uniform so that picture quality on the display panel is not uniformly displayed.

On the other hand, a method of increasing the line width of the power source wiring lines in order to reduce IR drop loaded in the power source wiring lines is provided. However, as the line width of the power source wiring lines increases, since the possibility of generating a short between the power source wiring lines and various other wiring lines increases, there are limitations on increasing the line width of the power source wiring lines.

SUMMARY OF THE INVENTION

The present invention has been developed in order to provide an organic light emitting display capable of preventing non-uniformity in brightness due to IR drop so as to improve the reliability of the organic light emitting display.

In order to achieve the above objective, the organic light emitting display comprises a display panel defined as a display region and a non-display region, a plurality of sub pixels defined by perpendicularly intersecting a plurality of gate lines and a plurality of data lines formed in the display region of the display panel, and a power source supply pad unit provided in the non-display region of the display panel for supplying power source voltage to the plurality of sub pixels. A resistance value of sub pixels arranged in a first region adjacent to the power source supply pad unit is higher than a resistance value of sub pixels of a second region which is separated from the power source supply pad unit with the first region interposed therebetween.

The sub pixel in the first region has a resistance value corresponding to a reduced voltage of the sub pixels of the second region. The resistance value of the sub pixels gradually increases from the second region toward the first region adjacent to the power source supply pad unit.

One of the sub pixels includes an organic light emitting diode (OLED) for displaying an image by means of a driving current, a driving switching element for transmitting a driving current corresponding to a data signal supplied from the data line to the OLED, and a power source supply switching element for transmitting a power source voltage of a power source wiring line electrically coupled to the power source supply pad unit to the driving switching element in response to an emission control signal of an emission control wiring line.

When a resistance value of a power source wiring line of the first region is R2, a resistance value of a power source wiring line of a region adjacent to the first region is R4, and resistance values of power source supply switching elements are R1, R3 and R5 from the first region toward the second region, where R1>R3>R5, and where:

R1=R2+R3 or R1=R2+R4+R5 and R3=R4+R5.

Line width of a first active layer which forms the power source supply switching element of the first region is larger than a line width of a second active layer which forms the power source supply switching element of the second region.

The size and number of first contact holes for coupling the first active layer, which forms the power source supply switching element of the first region, to a first source/drain electrode is smaller than the size and number of second contact holes for coupling a second active layer, which forms the power source supply switching element of the second region, to a second source/drain electrode.

The area of the first active layer which forms the power source supply switching element of the first region is smaller than the area of the second active layer which forms the power source supply switching element of the second region.

Voltages transmitted to the driving switching element for all of the sub pixels are the same. The resistance value of the power source supply switching element of the first region is higher than the resistance value of the power source supply switching element of the second region.

The power source supply switching element of the first region corresponds to a reduced voltage of the power source supply switching element of the second region. The resistance value of the power source supply switching element gradually increases from the second region toward the first region adjacent to the power source supply pad unit.

The resistance value of the sub pixel provided in the first region is designed by controlling the resistance value of the power source supply switching element of the sub pixel provided in the first region.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
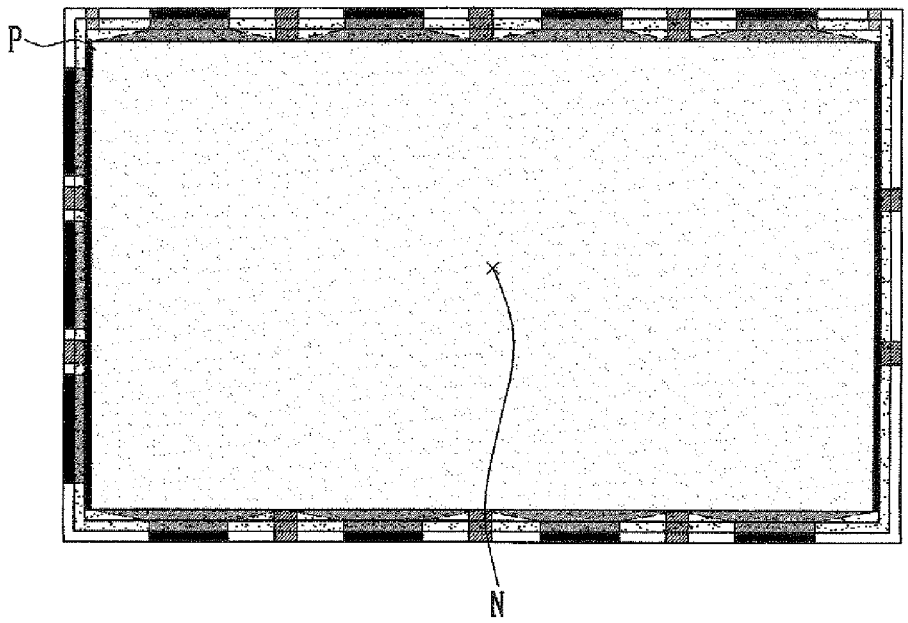
FIGS. 1 and 2 illustrate an organic light emitting display.

Hereinafter, certain exemplary embodiments according to the present invention will be described with reference to the accompanying drawings. When a first element is described as being coupled to a second element, the first element may be directly coupled to the second element or it may be indirectly coupled to the second element via a third element. Furthermore, some of the elements which are not essential to a complete understanding of the invention are omitted for clarity. Also, like reference numerals refer to like elements throughout.

Hereinafter, an organic light emitting display according to an embodiment of the present invention will be described in detail with reference to the accompanying drawings.

In the latter regard: (1) shapes, sizes, ratios, angles and numbers which are illustrated in the accompanying drawings may be slightly changed; (2) since the drawings are depicted from an observer's eyes, the directions and positions illustrating the drawings may be variously changed according to the observer's position; (3) different reference numerals may be assigned to the same part; (4) in the case where the terms "comprising", "having" and "including" are used, another term may be added when the term "only" is not used; (5) a singularity may be interpreted by plurality; (6) although shapes, comparison of size, and positional relationship are not explained by "about", "substantially", etc., the shapes, comparison of size, and positional relationship are interpreted to include usual error range; (7) although the terms "after ~", "before ~", "then", "and", "here", "next", "at this time" and "in this case" are used, the terms do not indicate a limitation of time position; (8) the terms "first", "second" and "third", etc. are used by convention to distinguish selectively, exchangeably or repeatedly, but are not interpreted to limit meaning; (9) in the case where positional relationship between two parts, such as "on ~", "above ~", "under ~" and "beside ~", is described, one or more other part may be positioned between the two parts when the term "directly" is not used; (10) when parts are connected by the term "or", the connection is interpreted to include not only the parts but also the combinations of the parts; and (11) when the parts are connected to each other by the term "one of ~, or ~", the connection means only the parts.

Hereinafter, an organic light emitting display according to an embodiment of the present invention will be described based on one sub pixel. However, the present invention may be applied to another sub pixel formed in the organic light emitting display according to the present invention.

Figure 2:
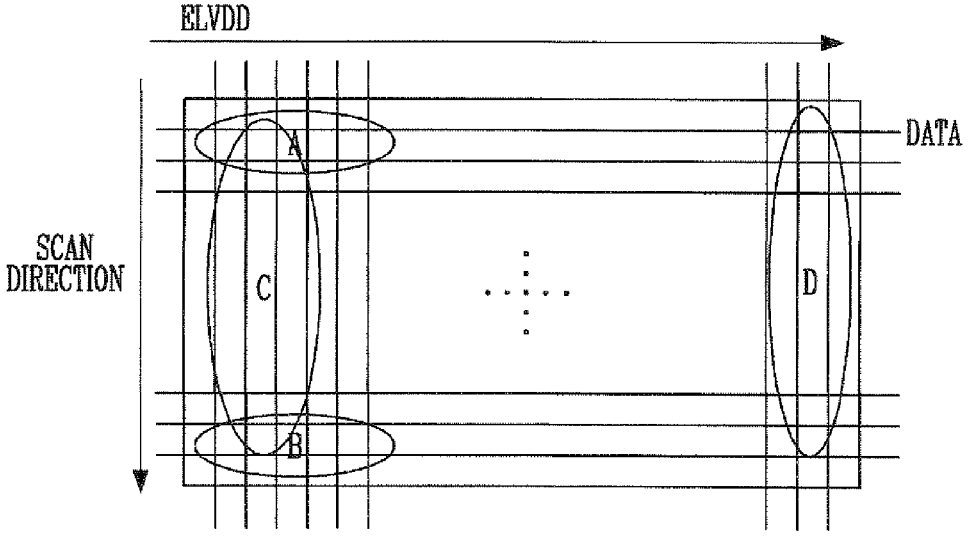

FIGS. 1 and 2 illustrate an organic light emitting display.

Referring to FIG. 1, the sub pixel P close to the power source supply pad unit emits light with high brightness, and the sub pixel N remote from the power source supply pad unit emits light with low brightness.

As the organic light emitting display is enlarged, the length of the power source wiring lines increases, and non-uniformity of brightness due to the IR drop of the power source wiring lines increases as the length of the power source wiring lines increases. Recently, in order to compensate for the IR drop of the power source wiring lines, a method of arranging the power source wiring lines in a row line rather than in a column line has been provided in order to compensate for the IR drop of the power source wiring lines.

Referring to FIG. 2, the resistance of the power source wiring lines of sub pixels B remote from sub pixels A which are close to the first row line increases in proportion to the length of the power source wiring lines. In addition, the resistance of the power source wiring lines of sub pixels D remote from sub pixels C which are close to the first column line increases in proportion to the length of the power source wiring lines. The voltages supplied to sub pixels having different power source wiring lines are not uniform so that picture quality on the display panel is not uniformly displayed.

Figure 3:
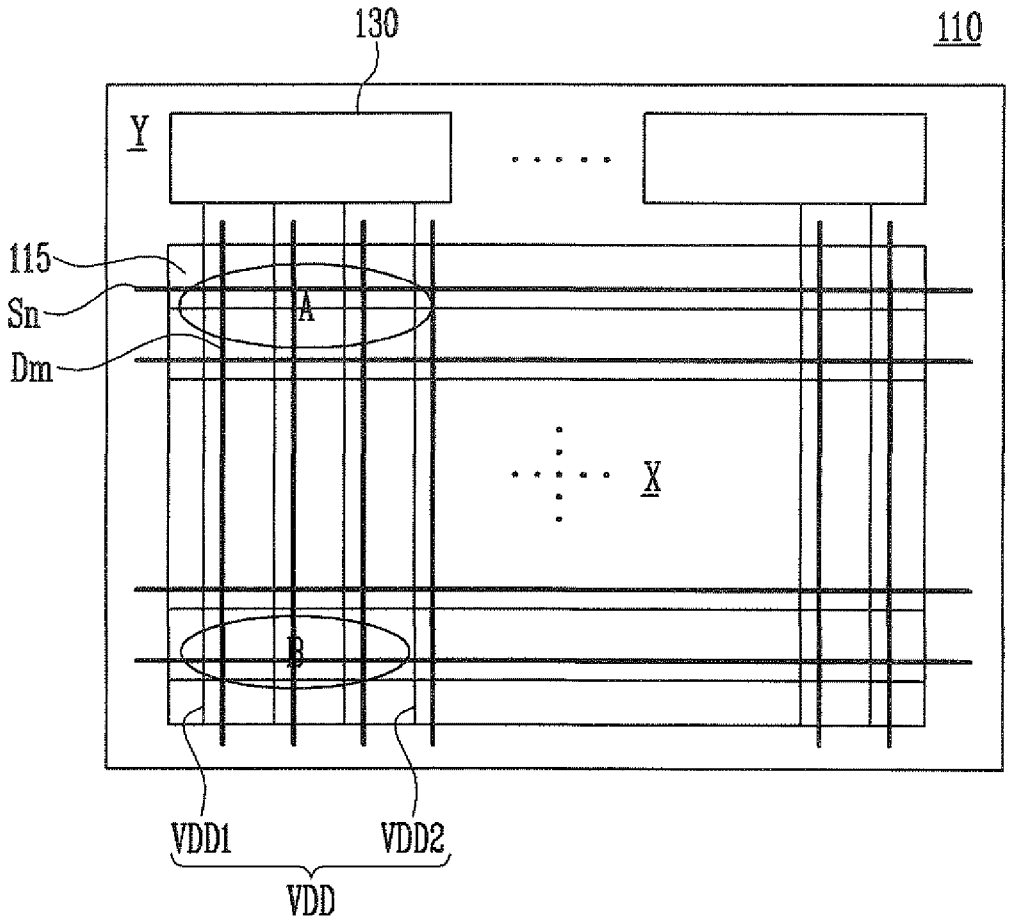
FIG. 3 is a view simply illustrating an organic light emitting display according to an embodiment of the present invention.
Figure 4:
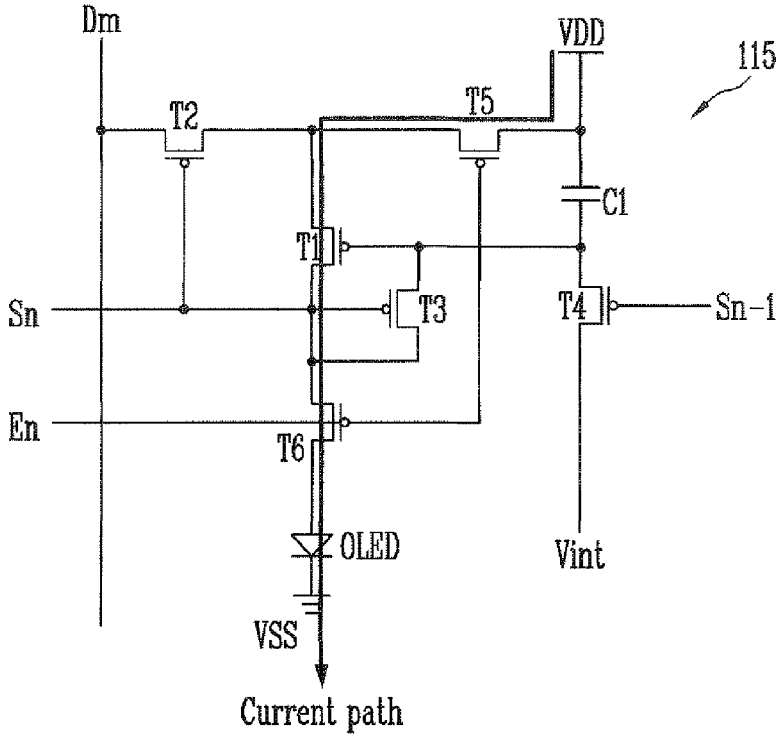
FIG. 4 is an equivalent circuit diagram of a sub pixel of an organic light emitting display according to the embodiment of FIG. 3.
Figure 5:
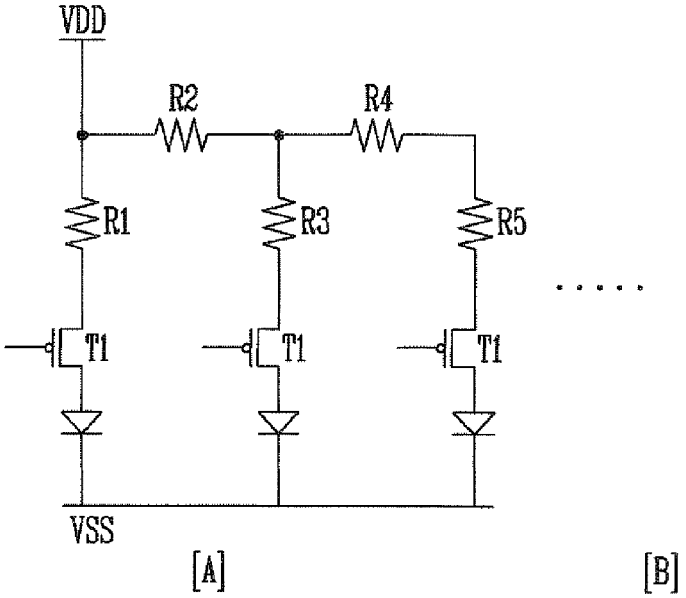
FIG. 5 is a view illustrating the design of the resistance value of the organic light emitting display according to the embodiment of FIG. 3.

FIG. 3 is a view simply illustrating an organic light emitting display according to an embodiment of the present invention; FIG. 4 is an equivalent circuit diagram of a sub pixel of an organic light emitting display according to the embodiment of FIG. 3; and FIG. 5 is a view illustrating the design of the resistance value of the organic light emitting display according to the embodiment of FIG. 3.

Referring to FIG. 3, an organic light emitting display according to an embodiment of the present invention includes a display panel 110 defined by a display region X and a non-display region Y, a plurality of gate lines Sn and a plurality of data lines Dm which perpendicularly intersect on the display panel 110 so as to define a plurality of sub pixels 115, and a power source supply pad unit 130 provided in the non-display region Y of the display panel 110 for applying power to the plurality of sub pixels 115.

The display region X of the display panel 110 may be defined as displaying an image and the non-display region Y of the display panel 110 may be defined as the outline region of the display region X. According to the present invention, a 6T1C structure will be described as an example. However, the present invention is not limited to the pixel circuit illustrated in the drawing.

The sub pixels 115 may be defined by perpendicularly intersecting the plurality of gate lines Sn−1 and Sn and the plurality of data lines Dm. The sub pixels 115 arranged in a first region A adjacent to the power source supply pad unit 130 are designed to have a higher resistance value than the outermost sub pixel 115 provided in a second region B separated from the power source supply pad unit 130 with the first region A interposed.

The resistance value of the sub pixels 115 arranged in the first region A, adjacent to the power source supply pad unit 130, corresponds to the voltage value corresponding to the voltage reduced to the voltage of the outermost sub pixel 115 provided in the second region B, separated from the power supply pad unit 130, with the first region A interposed therebetween. At this point, the resistance value of the sub pixels 115 gradually increases from the second region B toward the first region A adjacent to the power source supply pad unit 130.

Referring to FIG. 4, the sub pixel 115 includes an organic light emitting diode OLED for displaying an image by means of a driving current, a first switching element T1 electrically coupled to the OLED for supplying driving current, a storage capacitor C1, second to sixth switching elements T2 to T6, power source wiring lines VDD1 and VDD2 (see FIG. 3), and an emission control wiring line En.

Further referring to FIG. 4, the OLED includes an anode electrically coupled to the first switching element T1 via sixth switching element T6, and a cathode electrically coupled to a power source VSS. The OLED generates one of red (R), green (G) and blue (B) light components so as to correspond to the driving current supplied through the first switching element T1.

The first switching element T1 is a driving switching element for transmitting driving current, corresponding to the data signal supplied from the data line Dm, to the OLED.

Therefore, the first switching element T1 includes a first electrode (a source or a drain) electrically coupled to the first power source wiring line VDD via the fifth switching element T5, a second electrode (a drain or a source) electrically coupled to the anode of the OLED via the sixth switching element T6, and a gate electrode which operates in accordance with the data signal supplied from the data line Dm.

In this regard, the first electrode is set as one of a drain electrode and a source electrode, and a second electrode is set as another electrode. For example, when the first electrode is set as the source electrode, the second electrode is set as the drain electrode.

The storage capacitor C1 stores a voltage corresponding to the data signal between the first electrode (the source or the drain) and the gate electrode of the first switching element T1 so that the voltage required for the emission of the OLED is maintained.

Therefore, the storage capacitor C1 is positioned between the first switching element T1 and the first power source wiring line VDD. The storage capacitor C1 includes a first electrode electrically coupled to the control electrode (or the gate electrode) of the first switching element T1, and a second electrode electrically coupled to the power source wiring line VDD and to the first electrode (the source and the drain) of the first switching element T1.

The second switching element T2 is turned on when a gate signal is supplied to an nth gate line Sn so as to supply the data signal supplied to the data line Dm to the storage capacitor C1 via the first electrode of the first switching element T1.

Therefore, the second switching element T2 includes a first electrode coupled to the data line Dm, a second electrode coupled to the first electrode of the first switching element T1, and a gate electrode coupled to the nth gate line Sn.

The third switching element T3 is turned on when a gate signal is supplied to the nth gate line Sn so as to couple the first switching element T1 in the form of a diode.

Therefore, the third switching element T3 includes a gate electrode electrically coupled to the nth gate line Sn, a first electrode electrically coupled to the second electrode of the first switching element T1, and a second electrode electrically coupled to the gate electrode of the first switching element T1. At this point, the second electrode of the third switching element T3 may be electrically coupled to the first electrode of the storage capacitor C1.

The fourth switching element T4 is turned on when a previous gate signal is supplied to initialize the voltage stored in the storage capacitor C1. At this point, the voltage value of the initializing power source wiring line Vint is set to a smaller voltage value than the voltage value of the data signal, for example, a negative polar voltage value.

Therefore, the fourth switching element T4 includes a gate electrode electrically coupled to an (n−1)th gate line Sn−1, which is a previous gate line, a first electrode electrically coupled to the first electrode of the storage capacitor C1, and a second electrode electrically coupled to the initializing power source wiring line Vint. The first electrode of the fourth switching element T4 may also be electrically coupled to the gate electrode of the first switching element T1 or the second electrode of the third switching element T3.

The fifth switching element T5 transmits a power source voltage of the power source wiring line VDD to the first electrode of the first switching element T1, which is the driving switching element in accordance with the emission control signal supplied from the emission control wiring line En. That is, the fifth switching element T5, which is a power source supply switching element, electrically couples the power source voltage supplied through the power source wiring line VDD to the first switching element T1 in response to an emission control signal.

Therefore, the fifth switching element T5 includes a first electrode electrically coupled to the power source wiring line VDD, a second electrode electrically coupled to the first electrode of the first switching element T1, and a gate electrode electrically coupled to the emission control wiring line En via the sixth switching element T6.

The sixth switching element T6 controls the driving current which flows from the first switching element T1 to the OLED in accordance with the emission control signal supplied from the emission control wiring line En so as to determine the emission time of the OLED. At this point, the sixth switching element T6 is turned on when the emission control signal is not supplied (that is, when a low voltage is supplied) to electrically couple the first switching element T1 to the OLED.

Therefore, the sixth switching element T6 includes a first electrode electrically coupled to the second electrode of the first switching element T1, a second electrode electrically coupled to the anode of the OLED, and a gate electrode electrically coupled to the emission control wiring line En. The sixth switching element T6 may also be electrically coupled to the first electrode of the third switching element T3.

A power source wiring line VDD and a ground wiring line VSS supply a power source voltage and a reference voltage, respectively, for driving the sub pixel 115. At this point, the voltage supplied by the ground wiring line VSS has a lower voltage level than the voltage supplied by the power source wiring line VDD.

The power source wiring line VDD is electrically coupled to the power source supply pad unit 130 (see FIG. 3) provided in the non-display region Y of the display panel 110 so as to apply power source voltage to the plurality of sub pixels 115. The power source voltage supplied through the power source wiring line VDD is applied to the OLED (FIG. 4) of the sub pixel 115 through a current path which sequentially passes through the fifth switching element T5 which is the power source supply switching element turned on in response to the emission control signal, through the first switching element T1 which is the driving switching element, and through the sixth switching element T6 to the OLED of the sub pixel 115.

At this point, the fifth switching element T5 formed in each of the sub pixels arranged in the first region A adjacent to the power source supply pad unit 130 is designed to have a higher resistance value than the fifth switching element T5 formed in the second region B of the outermost sub pixels 115, which is separated from the power source supply pad unit 130 with the first region A interposed therebetween.

That is, the resistance value of the fifth switching element T5, which is the power source supply switching element for transmitting the voltage of the power source wiring line VDD to the first switching element T1 which is the driving switching element, is controlled so that the resistance value of the sub pixel 115 may be controlled.

The resistance value of the fifth switching element T5 formed in the sub pixel 115 provided in the first region A adjacent to the power source supply pad unit 130 corresponds to the voltage reduced to the fifth switching element T5 formed in the outermost sub pixel 115 of the second region B. At this point, the resistance value of the fifth switching element T5 formed in each of the sub pixels 115 gradually increases from the second region B toward the first region A.

That is, referring to FIG. 3 and FIG. 5, the resistance value of the power source wiring line VDD of the first region A adjacent to the power source supply pad unit 130 is denoted by R2, and the resistance value of the power source wiring line VDD of the region adjacent to the first region A is denoted by R4. When the resistance values of the fifth switching elements T5, which are the power source supply switching elements, are denoted by R1, R3, R5, then R1>R3>R5> from the first region A adjacent to the power source supply pad unit 130 toward the second region B. At this point, R1=R2+R3 or R1=R2+R4+R5 and R3+R4+R5.

In order to increase the resistance value of the fifth switching elements T5 of the first region A adjacent to the power source supply pad unit 130, the line width of the active layer which forms the fifth switching element T5, which is the power source supply switching element, is increased, or the area of the active layer which forms the fifth switching element T5 is reduced.

The area of the source/drain electrode or the area of the gate electrode which forms the fifth switching element T5 may be reduced. The size and number of contact holes which electrically couple the active layer, which forms the fifth switching element T5, to the source/drain electrode may be reduced.

As described above, when the resistance value of the fifth switching element T5 is designed by the sub pixel 115 in accordance with the distance from the power source supply pad unit 130, the voltage applied to the first switching element T1, which is the driving switching element, is the same with respect to all of the sub pixels. Therefore, according to the present invention, since the voltage in accordance with IR drop generated as the length of the power source wiring line VDD increases may be compensated for in each sub pixel, non-uniformity of picture quality due to an IR drop may be prevented.

On the other hand, according to the present invention, as illustrated in FIG. 3, the power source supply pad unit 130 is provided in the non-display region Y in the upper region of the long side of the display panel 110. However, the present invention is not limited to the latter arrangement. That is, the power source supply pad unit may be provided in the non-display region Y in the lower region of the long side of the display panel 110.

When the power source supply pad unit is provided in the non-display region Y in the lower region of the long side of the display panel 110, the structure of the fifth switching element of each of the sub pixels adjacent to the power source supply pad unit is the same as the structure of the fifth switching element formed in the first region A.

Hereinafter, the structure of the fifth switching element T5 for controlling the resistance value of the sub pixels 115 arranged in the first region A adjacent to the power source supply pad unit 130 will be compared to the structure of the fifth switching element T5 of each of the outermost sub pixels 115 arranged in the second region B.

Figure 6:
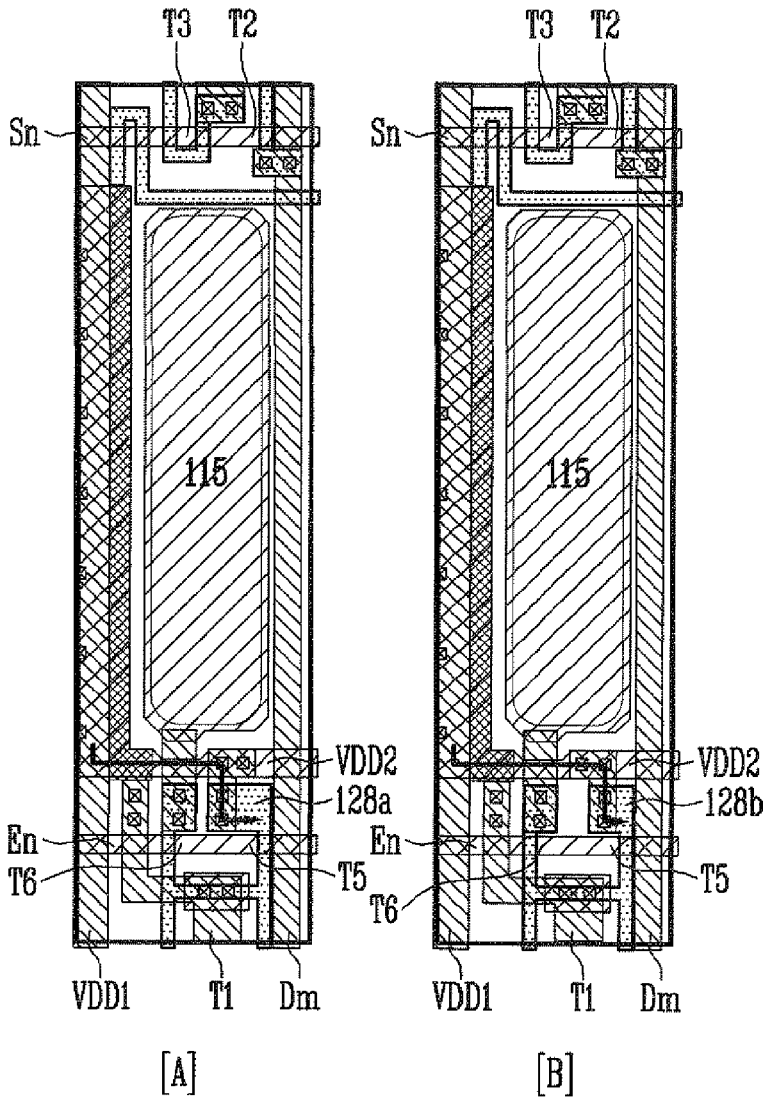
FIG. 6 is a layout diagram illustrating the organic light emitting display according to the embodiment of FIG. 3.

FIG. 6 is a layout diagram illustrating the organic light emitting display according to the embodiment of FIG. 3.

Referring to FIG. 6, the line width of a first active layer 128*a*, which forms the fifth switching element T5 of the sub pixel 115 provided in the first region A adjacent to the power source supply pad unit, may be designed so as to be larger than the line width of a second active layer 128*b* which forms the fifth switching element T5 of the second region B separated from the power source supply pad unit with the first region A interposed therebetween.

At this point, since the path of the power source voltage applied through the power source wiring lines VDD1 and VDD2 increases by the length of the increased line width, the resistance value of the sub pixels arranged in the first region A adjacent to the power source supply pad unit increases. That is, the resistance value of the fifth switching element T5 of each of the sub pixels 115 arranged in the first region A is increased so as to prevent the IR drop of the sub pixels 115 arranged in the second region B.

Figure 7:
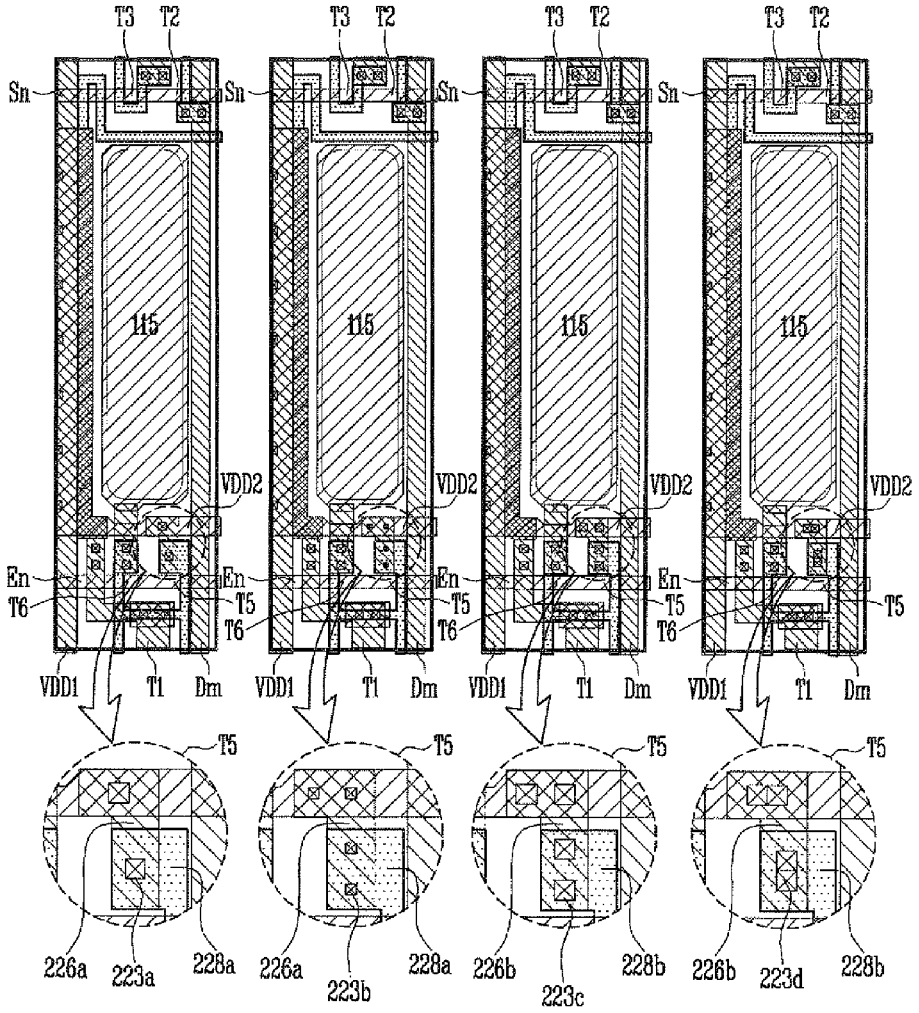
FIG. 7 is a layout diagram illustrating an organic light emitting display according to another embodiment of the present invention of FIG. 3.

FIG. 7 is a layout diagram illustrating an organic light emitting display according to another embodiment of the present invention of FIG. 3.

Referring to FIG. 7, the size and number of first contact holes 223*a* and 223*b* for coupling the first active layer 228*a*, which forms the fifth switching element T5 of the sub pixel 115 provided in the first region A adjacent to the power source supply pad unit, to a first source/drain electrode 226*a* may be designed so as to be smaller than the size and number of second contact holes 223*c* and 223*d* for coupling a second active layer 228*b*, which forms the fifth switching element T5 of the second region B, to a second source/drain electrode 226*b*.

At this point, since the power source voltage applied through the power source wiring lines VDD1 and VDD2 flows through the circumference of the contact hole, as the size and number of contact holes are smaller, the resistance value of the sub pixels 115 arranged in the first region A adjacent to the power source supply pad unit increases. Therefore, the resistance value of the fifth switching element T5 of each of the sub pixels 115 arranged in the first region A is increases so that an IR drop of the sub pixels 115 arranged in the second region B may be prevented.

Figure 8:
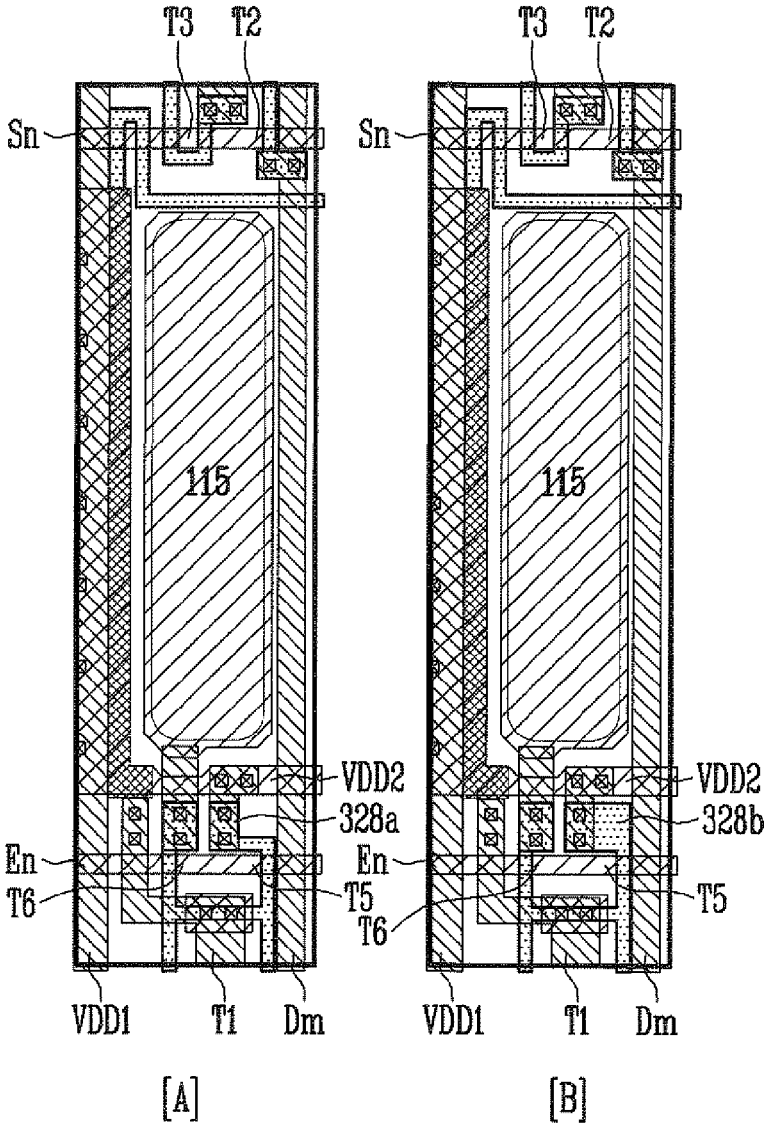
FIG. 8 is a layout diagram illustrating an organic light emitting display according to still another embodiment of the present invention of FIG. 3.

FIG. 8 is a layout diagram illustrating an organic light emitting display according to still another embodiment of the present invention of FIG. 3.

Referring to FIG. 8, the area of a first active layer 328*a*, which forms the fifth switching element T5 of the sub pixel

115 provided in the first region A adjacent to the power source supply pad unit, may be designed to be smaller than the area of a second active layer 328*b* which forms the fifth switching element T5 of the second region B.

At this point, the resistance value of the sub pixel 115 provided in the first region A increases so as to correspond to the reduced area of the first active layer 328*a*. Therefore, the resistance value of the fifth switching element T5 of each of the sub pixels 115 arranged in the first region A is increased so as to prevent an IR drop of the sub pixels 115 arranged in the second region B.

The organic light emitting display according to the present invention controls the resistance value of the fifth switching element formed in each of the sub pixels arranged in the first region A adjacent to the power source supply pad unit so as to prevent an IR drop of the sub pixels arranged in the second region B separated from the power source supply pad unit with the first region A interposed.

Therefore, the organic light emitting display according to the present invention prevents the IR drop even though the length of the power source wiring line increases so as to stabilize the picture quality and improve the reliability of the organic light emitting display.

Since the gate line Sn, the data line Dm, the emission control wiring line En, the first to fourth switching elements T1 to T4, and the sixth switching element T6, which are not described in FIGS. 6, 7 and 8, are the same as the elements described in the equivalent circuit diagram of FIG. 4, a description thereof is omitted.

While the present invention has been described in connection with certain exemplary embodiments, it is to be understood that the invention is not limited to the disclosed embodiments, but, on the contrary, it is intended to cover various modifications and equivalent arrangements included within the spirit and scope of the appended claims, and equivalents thereof.

What is claimed is:

1. An organic light emitting display, comprising:

a display panel having a display region and a non-display region;

a plurality of sub pixels defined by perpendicularly intersecting a plurality of gate lines and a plurality of data lines formed in the display region of the display panel; and a power source supply pad unit provided in the non-display region of the display panel for supplying a power source voltage to the plurality of sub pixels;

wherein a resistance value of sub pixels arranged in a first region adjacent to the power source supply pad unit is higher than a resistance value of sub pixels of a second region which is separated from the power source supply pad unit, with the first region interposed therebetween, wherein one of the sub pixels comprises:

an organic light emitting diode (OLED) for displaying an image by means of a driving current;

a driving switching element for transmitting the driving current in correspondence to a data signal supplied from a data line to the OLED; and a power source supply switching element for transmitting a power source voltage of a power source wiring line, electrically coupled to the power source supply pad unit, to the driving switching element in response to an emission control signal of an emission control wiring line, and wherein an area of a first active layer, which forms the power source supply switching element of the first region, is smaller than an area of a second active layer, which forms the power source supply switching element of the second region.

2. The organic light emitting display as claimed in claim 1, wherein the sub pixel in the first region has a resistance value corresponding to a reduced voltage of the sub pixels of the second region.

3. The organic light emitting display as claimed in claim 1, wherein the resistance value of the sub pixels gradually increases from the second region toward the first region adjacent to the power source supply pad unit.

4. The organic light emitting display as claimed in claim 1, wherein, when a resistance value of a power source wiring line of the first region is R2, a resistance value of a power source wiring line of a region adjacent to the first region is R4, and resistance values of power source supply switching elements are R1, R3 and R5 from the first region toward the second region, wherein R1>R3>R5.

5. The organic light emitting display as claimed in claim 4, wherein R1=R2+R3.

6. The organic light emitting display as claimed in claim 4, wherein R1=R2+R4+R5 and R3=R4+R5.

7. The organic light emitting display as claimed in claim 1, wherein voltages transmitted to the driving switching element for all of the sub pixels are the same.

8. The organic light emitting display as claimed in claim 1, wherein a resistance value of the power source supply switching element of the first region is higher than a resistance value of the power source supply switching element of the second region.

9. The organic light emitting display as claimed in claim 1, wherein a resistance value of the power source supply switching element of the first region corresponds to a reduced voltage of the power source supply switching element of the second region.

10. The organic light emitting display as claimed in claim 1, wherein a resistance value of the power source supply switching element gradually increases from the second region toward the first region adjacent to the power source supply pad unit.

11. The organic light emitting display as claimed in claim 1, wherein the resistance value of the sub pixel provided in the first region is designed by controlling a resistance value of the power source supply switching element of the sub pixel provided in the first region.

* * * * *